United States Patent [19]

Harwood et al.

[11] Patent Number: 4,777,708

[45] Date of Patent: Oct. 18, 1988

[54] METHOD FOR MANUFACTURING AN EXHAUST MANIFOLD

[75] Inventors: Jon Harwood, Toledo, Ohio; Donald Kohler, Fenton, Mich.

[73] Assignee: AP Industries, Inc., Toledo, Ohio

[21] Appl. No.: 27,154

[22] Filed: Mar. 17, 1987

[51] Int. Cl.[4] ..... B21O 53/84

[52] U.S. Cl. ..... 29/157 R; 29/157.6; 60/323; 123/52 M; 228/173.3

[58] Field of Search ..... 29/156.4 R, 157 R, 157.4, 29/157.6; 60/323; 123/52 M; 219/60.2, 93; 228/173.3

[56] References Cited

U.S. PATENT DOCUMENTS

| | | | |
|---|---|---|---|
| 1,852,180 | 4/1932 | McKnight et al. | 29/157.4 X |
| 2,685,383 | 8/1954 | Kochner | 219/93 X |
| 3,190,952 | 6/1965 | Bitko | 174/525 |
| 3,251,127 | 5/1966 | Tonelli | 228/196 |
| 3,629,544 | 12/1971 | Becker | 219/93 |
| 3,667,432 | 6/1972 | Greathouse | 123/52 M |
| 3,703,083 | 11/1972 | Tadokoro | 60/322 |
| 3,805,013 | 4/1974 | Becker | 219/92 |
| 3,872,666 | 3/1975 | Bentley | 60/277 |
| 3,908,365 | 9/1975 | Schweibold et al. | 60/274 |
| 3,940,927 | 3/1976 | Maurhoff et al. | 60/322 X |
| 3,982,396 | 9/1976 | Suzuki | 60/322 X |
| 4,215,093 | 7/1980 | Yasuda | 29/157 R X |
| 4,273,983 | 6/1981 | Ogawa et al. | 219/93 |
| 4,369,911 | 1/1983 | Blumenberg | 29/157 R X |
| 4,382,172 | 5/1983 | Takasugi et al. | 219/93 X |
| 4,409,460 | 10/1983 | Nishii et al. | 219/93 |
| 4,537,027 | 8/1985 | Harwood et al. | 60/323 |
| 4,689,952 | 9/1987 | Arthur et al. | 60/323 X |

FOREIGN PATENT DOCUMENTS

| | | | |
|---|---|---|---|
| 1002576 | 2/1957 | Fed. Rep. of Germany | 219/93 |
| 1055718 | 4/1959 | Fed. Rep. of Germany | 219/93 |
| 1286368 | 1/1962 | France . | |
| 99751 | 8/1979 | Japan | 219/60.2 |
| 88995 | 7/1980 | Japan | 219/60.2 |
| 144881 | 11/1981 | Japan | 219/93 |

OTHER PUBLICATIONS

"Stainless Manifold Gains Momentum" published in *Muffler Digest* of Aug. 1979, pp. 30, 31.

*Primary Examiner*—P. W. Echols
*Assistant Examiner*—Andrew E. Rawlins
*Attorney, Agent, or Firm*—Anthony J. Casella; Gerald E. Hespos

[57] ABSTRACT

A process is provided for manufacturing an exhaust manifold. The manifold comprises at least one stamp formed inlet flange, a stamp formed sheet metal inner shell and a stamp formed sheet metal outer shell. The inner shell and outer shell are configured to define an exhaust chamber therebetween. Each inlet flange is stamp formed to define at least one exhaust port extending entirely therethrough, with each exhaust port including a stamp formed projection extending continuously thereabout from one surface of the inlet flange. The inner shell is stamp formed to define an inlet aperture for each exhaust port. The inner shell is projection welded to the inlet flange such that the projections stamp formed therein define the weldments. The outer shell then is welded to the inner shell to define the exhaust chamber of the manifold. An outlet tube may be secured to an outlet aperture of the outer shell.

5 Claims, 3 Drawing Sheets

METHOD FOR MANUFACTURING AN EXHAUST MANIFOLD

BACKGROUND OF THE INVENTION

The exhaust gases generated by a vehicular engine are collected by a manifold securely mounted to the engine. The manifold is further connected to the exhaust system of the vehicle to enable transportation of the exhaust gases to a location on the vehicle from which the exhaust gases can be conveniently and safely dispersed. The exhaust system typically will comprise a catalytic converter to reduce certain noxious pollutants and a muffler to reduce the noise levels associated with the flowing exhaust gases. Many engine configurations require the use of a plurality of exhaust manifolds to be mounted to the engine. These manifolds may lead to a single exhaust system or to entirely separate systems.

The size and shape of the exhaust manifold have become important design criteria in recent years. More particularly, the exhaust manifold must compete for the limited space in the engine compartment of the vehicle with various accessories to the engine and with required pollution control equipment.

One type of prior art exhaust manifold has been cast from an appropriate metallic material. These cast manifolds can result in cost efficiencies for very large manufacturing runs and can be cast into a wide range of possible shapes. However, the cast metal manifolds typically are relatively heavy and thus impose an associated penalty on operational performance. Additionally, the cast metal manifolds function as a heat sink which absorbs the heat of combustion and causes the catalytic converter to light-off more slowly.

Another type of prior art manifold is formed from an array of tubes equal in number to the cylinders on the engine. Mounting plates are welded to one end of each tube to enable the tubes to be mounted over the respective exhaust ports of the engine cylinders. The opposed ends of the tubes are joined together. Tubular exhaust manifolds are generally lighter than cast metal manifolds but require a plurality of complex bends and cuts to be made in each tubular member. The appropriately bent and cut tubular members must then be welded to one another along a plurality of irregularly shaped and often inaccessible locations. As a result, the manufacture of tubular manifolds is a relatively labor intensive process in which there is a significant possibility of error.

A relatively recent improvement over the prior art cast metal manifolds and tubular manifolds is shown in U.S. Pat. No. 4,537,027 which issued to Jon Harwood et al on Aug. 27, 1985 and is assigned to the assignee of the subject invention. The disclosure of U.S. Pat. No. 4,537,027 is incorporated herein by reference. Briefly, U.S. Pat. No. 4,537,027 is directed to a hybrid manifold and a method of forming the same wherein the manifold includes stamp formed, tubular and machined parts. The manifold disclosed in U.S. Pat. No. 4,537,027 comprises a generally planar inlet flange adapted to be mounted on the engine and having at least one exhaust port extending therethrough to be in register with at least one cylinder of the engine. A stamp formed sheet metal inner shell is formed with a plurality of inlet apertures disposed to be in register with the associated exhaust ports of the planar inlet flange. The manifold disclosed in U.S. Pat. No. 4,537,027 further comprises a stamp formed sheet metal outer shell attached to the inner shell to define an exhaust chamber therebetween. The outer shell includes an outlet aperture extending therethrough to which an outlet tube is welded. The outlet tube is adapted to be connected to the exhaust pipe of an appropriate exhaust system on the vehicle. The manifold shown in U.S. Pat. No. 4,537,027 provides many desirable advantages including a relatively light weight, a relatively low cost, an ability to conform to virtually any available space envelope and a relatively easy manufacturing and assembly process. More particularly, the assembly of the components of the manifold disclosed in U.S. Pat. No. 4,537,027 can be designed with a weld line between the stamp formed sheet metal inner and outer shells that is very accessible and well suited to automation. The manifold of U.S. Pat. No. 4,537,027 also requires the welding of the stamp formed sheet metal inner shell to the planar inlet flange at the associated exhaust ports therein.

Although the manifold of U.S. Pat. No. 4,537,027 provides many advantages, it has been desired to further improve manufacturing efficiencies. In particular, it has been desired to provide a more efficient method for forming and connecting the planar inlet flange and the stamp formed sheet metal inner shell. In this regard, it should be noted that the manifold shown in U.S. Pat. No. 4,537,027 shows the formation of a planar inlet flange wherein the opposed surfaces thereof are substantially parallel and planar entirely thereacross. The exhaust ports formed in the inlet flange have sidewalls that typically are machined to define a chamfer at their intersection with the surface of the inlet flange to be adjacent with the stamp formed sheet metal inner shell. The stamp formed sheet metal inner shell was then formed with inlet apertures therein the same size and shape as the exhaust ports of the inlet flange. More particularly, each inlet aperture was stamp formed to define a mounting flange that would telescopingly engage the corresponding exhaust port of the inlet flange. The mounting flange then would be welded to the inlet flange adjacent the surface of the inlet flange opposite the stamp formed inner shell. Despite the functional and manufacturing advantages of the manifold of U.S. Pat. No. 4,537,027, these welds of the inner shell mounting flanges to the planar inlet flange required considerable care. Specifically, any excess weldments disposed on the surface of the inlet flange would have to be machined off to ensure a smooth surface for mounting to the engine. Similarly, in certain applications, the welding material that might spill into the manifold would have to be removed prior to installation of the manifold onto the vehicle. These additional manufacturing steps could impose certain penalties on an otherwise extremely desirable and efficient manufacturing process.

Projection welding has been employed in certain manufacturing processes to secure discrete points on two members to one another. Thus, one of the two members typically is formed with a point-like projection against which the second of the members to be welded is positioned. The electrode of a welding apparatus makes contact with the second member in line with the projection. The projection thus defines the weldment that fuses the two members together.

Projection welding often is used to secure a bracket or stud to a planar surface on a frame, engine block or the like. The projection employed in prior art projection welding processes typically was formed by machining or during the casting of the more massive of the members to be welded. However, stamp formed projections are shown in: U.S. Pat. No. 3,190,952 which issued to Bitko on June 22, 1965; U.S. Pat. No. 3,251,127 which issued to Tonelli on May 17, 1986; U.S. Pat. No. 3,629,544 which issued to Becker on Dec. 21, 1971; and U.S. Pat. No. 4,409,460 which issued to Nishii on Oct. 11, 1983. The prior art did not employ projection welding in the manufacture of exhaust system components. The prior art also does not suggest stamp forming a projection and an aperture in a single stamping process such that the projection defines the periphery of the aperture. Furthermore, the prior art does not suggest projection welding a plurality of annular projections simultaneously. Additionally, the prior art does not suggest the combination of projection welding and a telescoping engagement of members at an aperture to ensure an efficient and clean weld around the aperture.

In view of the above, it is an object of the subject invention to provide an efficient method for manufacturing an exhaust manifold.

It is another object of the subject invention to provide an efficient method for securing the stamp formed sheet metal inner shell of a hybrid exhaust manifold to the inlet flange thereof.

It is an additional object of the subject invention to provide a method for manufacturing a hybrid exhaust manifold that avoids machining operations to remove excess weld material.

A further object of the subject invention is to provide a more efficient method for forming the inlet flange of a hybrid exhaust manifold.

Still another object of the subject invention is to provide a method for manufacturing a hybrid exhaust manifold including an extremely fast and efficient method of joining a stamp formed sheet metal inner shell thereof to the inlet flange.

SUMMARY OF THE INVENTION

The subject invention is directed to a particularly efficient method for manufacturing an exhaust manifold. The method includes the first step of stamp forming at least one generally planar inlet flange to be mounted on the engine. In certain embodiments, the manifold will be provided with a single inlet flange to provide communication with all of the plurality of engine exhaust ports with which the manifold communicates. In other embodiments, the manifold may be provided with a plurality of separate inlet flanges each of which will communicate with one or more engine exhaust ports.

The inlet flange may be stamp formed from a planar sheet of metallic material which preferably has a thickness of 0.15 inches to 0.40 inches. The stamp forming of each inlet flange of the hybrid exhaust manifold is carried out to define at least one exhaust port extending entirely therethrough. Additionally, the stamp forming is carried out to define a continuous projection extending around each exhaust port of the inlet flange. The continuous projection extends from one of the two opposed planar parallel surfaces of the inlet flange and is substantially adjacent the associated exhaust port. The projection may be formed by the flowing of metallic material as the exhaust ports are stamp formed into the inlet flange. More particularly, the female portion of the die may be configured to permit the formation of the projection as the exhaust port is formed. Thus, the aperture in the female portion of the die may include a chamfered entrance, with the shape of the chamfer corresponding to the required shape of the projection. The projection may form a well defined edge. The surfaces which define the edge of the projection may intersect at an angle of between 30° and 60°, and preferably at an angle of approximately 45°. The height of the projection from the adjacent planar surface of the inlet flange will be determined in part by the thicknesses of the adjacent materials of the hybrid manifold. In most embodiments, the projection will have a height of between approximately 0.04 and 0.06 inches.

The process of the subject invention further includes the step of stamp forming an inner shell from a sheet metal material. The sheet metal of the inner shell may have a thickness of between approximately 0.04 and 0.06 inches. Preferably, a single inner shell will be provided for the entire exhaust manifold and will be dimensioned to extend substantially entirely across the exhaust ports of each inlet flange of the manifold. The major portion of the inlet flange will be generally planar. However, the inlet flange will be stamp formed to define an inlet aperture for each exhaust port in the at least one inlet flange. Each inlet aperture may be substantially the same size and shape as the corresponding exhaust port, and may further be characterized by a mounting flange unitary with the inner shell and extending orthogonal to the planar portion thereof. Each mounting flange will be dimensioned to closely engage the perimeter of the corresponding exhaust port of the inlet flange. Furthermore, each mounting flange will extend a distance less than or equal to the thickness of the inlet flange. The inner shell may further be stamp formed to define a peripheral flange extending continuously around the inner shell in a direction opposite the mounting flanges.

The manifold of the subject invention is further defined by stamp forming a sheet metal outer shell. The outer shell is stamp formed to mate with the inner shell such that an exhaust chamber is formed therebetween. The stamp forming of the outer shell may further define a peripheral flange that is dimensioned to align with or engage a peripheral flange stamp formed on the inner shell. The stamp forming of the outer shell is further carried out to define an outlet aperture extending entirely therethrough. The outlet aperture may be configured to engage an outlet tube which, in turn, may be connectable to a portion of the exhaust system, such as the exhaust pipe.

The exhaust manifold of the subject invention is assembled by first positioning the inner shell relative to the at least one inlet flange such that the inlet apertures of the inner shell are in register with the corresponding exhaust ports of the inlet flange. More particularly, each inlet flange may be oriented such that the above described projections thereof face the planar portion of the stamp formed sheet metal inner shell. Thus, the mounting flanges of the inner shell may be telescopingly urged into the corresponding exhaust ports of the inlet flange, and the respective projections may contact and abut the planar portion of the inner shell substantially adjacent the corresponding mounting flange.

The inner shell and the inlet flange next are securely connected to one another by projection welding. More particularly, a unique projection welding device may be employed to engage the portions of the inner shell substantially directly opposite the projections of the inlet flange. By this process, each continuous projection defined during the stamp forming of the inlet flange will become a continuous weldment securely and permanently joining the inlet flange and the inner shell. The welding apparatus preferably will include an electrode which conforms generally to the shape of the continuous projection extending from the inlet flange. In the preferred method, the electrode welds the entire continuous projection simultaneously. As a result of this process, a continuous weld is provided around each exhaust port but on the side of the inlet flange opposite the surface to be mounted on the engine. By virtue of disposing the weld at this location, there is virtually no possibility of weld material being disposed on the surface of the inlet flange that will be mounted on the engine. Consequently, grinding or other such cleaning operations are avoided. Furthermore, this particular location of the welded connection between the inlet flange and the inner shell positively prevents stray weld material from falling into the internal portion of the manifold.

The process of the subject invention further includes the step of welding the inner and outer shells to define an exhaust chamber therebetween. This process step is carried out subsequent to the projection welding of the inner shell to the inlet flange.

DETAILED DESCRIPTION OF THE PREFERRED EMBODIMENT

Figure 1:
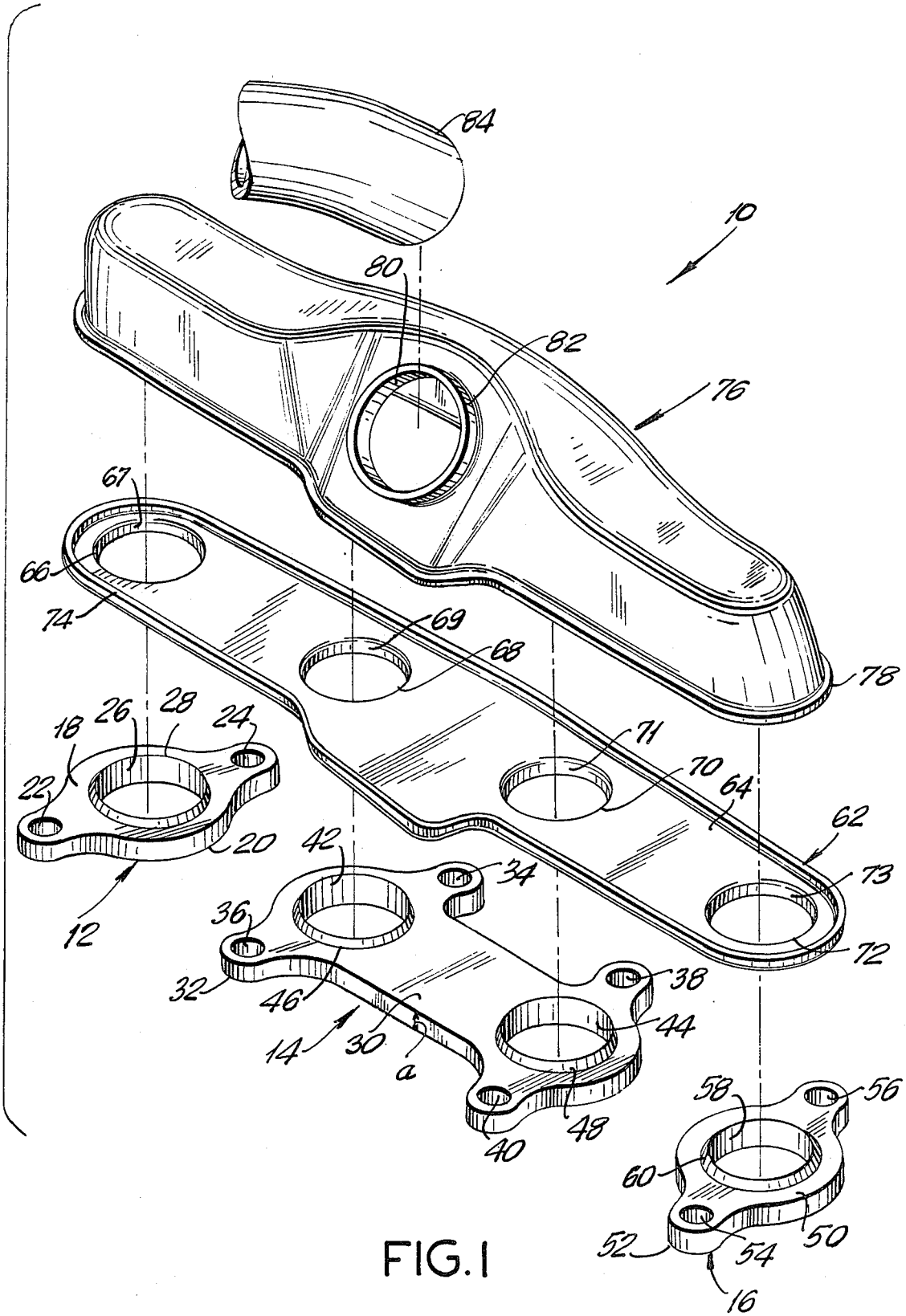
FIG. 1 is an exploded perspective view of a manifold formed in accordance with the subject invention.

The manifold of the subject invention is indicated generally by the numeral 10 in FIG. 1. The manifold 10 includes inlet flanges 12, 14 and 16 which are stamp formed from at least one generally planar sheet of metal having a thickness "a" of between approximately 0.15 inches and 0.40 inches. The inlet flange 12 includes opposed generally parallel planar surfaces 18 and 20 and mounting apertures 22 and 24 extending entirely therethrough. The mounting apertures 22 and 24 may be stamp formed or machined and are disposed to align with threaded apertures on the engine. Thus, the mounting apertures 22 and 24 will enable the manifold 10 to be securely mounted to the engine. The inlet flange 12 is further provided with a stamp formed exhaust port 26 which is dimensioned and located to align with a cylinder on the engine. As will be explained further below, the stamp forming of the exhaust port 26 in the inlet flange 12 is carried out to define a substantially continuous annular projection 28 extending around the exhaust port 26 and from surface 18.

The inlet flange 14 is similar to the inlet flange 12 but is dimensioned and configured to communicate with two cylinders on the engine. More particularly, inlet flange 14 includes opposed generally parallel planar surfaces 30 and 32 and mounting apertures 34, 36, 38 and 40 to enable the inlet flange 14 to be securely mounted to threaded apertures on the engine. The inlet flange 14 is stamp formed to define exhaust ports 42 and 44 extending entirely therethrough. As with the inlet flange 12, the exhaust ports 42 and 44 of inlet flange 14 are stamp formed to define substantially continuous peripheral annular projections 46 and 48 respectively. The projections 46 and 48 both project from the surface 30 of inlet flange 14.

The inlet flange 16 is similar to inlet flanges 12 and 14 and includes opposed parallel generally planar surfaces 50 and 52. Mounting apertures 54 and 56 extend entirely between the surfaces 50 and 52 and are disposed to be registrable with threaded apertures on the engine to which the inlet flange 16 may be mounted. The inlet flange 16 is further provided with an exhaust port 58 which is stamp formed to define a continuous peripheral annular projection 60 thereabout extending from surface 50.

The inlet flanges 12, 14 and 16 are stamp formed such that the projections 28, 46, 48 and 60 thereof will extend away from the engine when the inlet flanges 12, 14 and 16 are mounted thereto.

The manifold 10 further includes an inner shell stamp formed from a sheet metal substantially thinner than the metal plate from which the inlet flanges 12, 14 and 16 are stamp formed. Typically, the inner shell will be stamp formed from a sheet metal having a thickness of between approximately 0.04 inches and 0.06 inches. The inner shell 62 is stamp formed to define a generally planar portion 64 and inlet apertures 66, 68, 70 and 72 which are dimensioned and located to be substantially in register with the exhaust ports 26, 42, 44 and 58 respectively when the inlet flanges 12, 14 and 16 are mounted on the engine. The inlet apertures 66, 68, 70 and 72 are stamp formed to define mounting flanges 67, 69, 71 and 73 respectively which extend orthogonally from the planar portion 64 and are dimensioned to telescopingly engage the respective exhaust ports 26, 42, 44 and 58. The stamp forming of the inner shell 62 further defines a continuous peripheral flange 74 extending entirely thereabout. The peripheral flange 74 extends from the planar portion 64 in a direction opposite the mounting flanges 67, 69, 71 and 73.

The manifold 10 further comprises an outer shell 76 which is stamp formed to mate with the inner shell 62 and define an exhaust chamber therebetween. The outer shell 76 includes a generally planar peripheral flange 78 which is configured to engage the planar portion 64 of the inner shell 62 substantially adjacent the peripheral flange 74 thereof. As will be explained further below, the peripheral flange 78 of the stamp formed outer shell 76 will be welded to the inner shell 62 substantially adjacent the peripheral flange 74 thereof. The planar configuration of the peripheral flange 78 makes this welding process easy and well suited to automation. However, it is to be understood that various non-planar configurations of the weld seam between the inner shell 62 and the outer shell 76 may be carried out by various automated welding equipment and are within the scope of this invention. The outer shell 76 is further stamp formed to define an outlet aperture 80 defined in part by an outlet mounting flange 82.

The manifold 10 further comprises an outlet tube 84 that will be welded to the outlet mounting flange 82 at the outlet aperture 80 of the outer shell 76.

Figure 2:
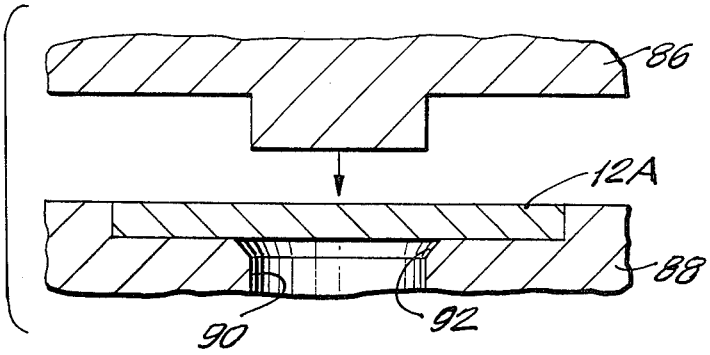
FIG. 2 is a schematic cross-sectional view of a stamping apparatus used to practice the subject invention.
Figure 3:
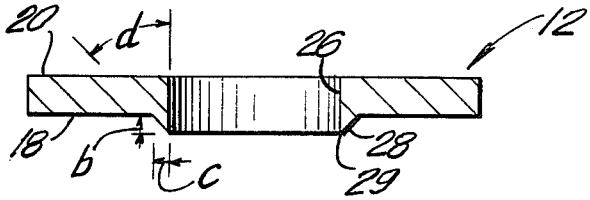
FIG. 3 is a cross-sectional view of an inlet flange formed in accordance with the subject invention.

The stamp forming of the exhaust port 26 in the inlet flange 12 is illustrated schematically in FIGS. 2 and 3. More particularly, the inlet flange 12 is stamp formed from a planar solid metal plate 12A by a stamping apparatus which comprises a male die 86 and a female die 88. The female die 88 includes an aperture 90 having a chamfer 92 on the portion thereof adjacent the metal plate 12A. As a result of the chamfer 92, the deformation of the metal plate 12A during the stamping operation defines the continuous projection 28 surrounding the exhaust port 26 in inlet flange 12. The size and shape of the chamfer 92 will define the size and shape of the projection 28. Preferably, the projection 28 will define a continuous substantially annular ridge 29 defining the portion thereof most distant from the planar surface 18 from which the projection 28 extends. Preferably, the height of the projection 28 away from the planar surface 18, as indicated by dimension "b" in FIG. 3, will be equal to the thickness of the sheet metal from which the inner shell 62 is formed. Similarly, the maximum radial thickness of the projection 28 substantially in line with the planar surface 18, as indicated by dimension "c" in FIG. 3 will be substantially equal to the thickness of the sheet metal from which the inner shell 62 is formed. As a result of these dimensions, the angle "d" defined by the surfaces forming the projection 28 will be approximately equal to 45°.

The process for manufacturing the inlet flanges 14 and 16 will be substantially similar to the process described above and illustrated schematically in FIGS. 2 and 3. Additionally, this process will be carried out to further define the mounting apertures 22 and 24 in inlet flange 12 and the comparable mounting apertures on inlet flanges 14 and 16. These mounting apertures may be stamp formed, or may be appropriately machined, depending upon the thickness of the metal plate from which the inlet flanges 12, 14 and 16 are formed and the dimensions of the respective mounting apertures.

Figure 4:
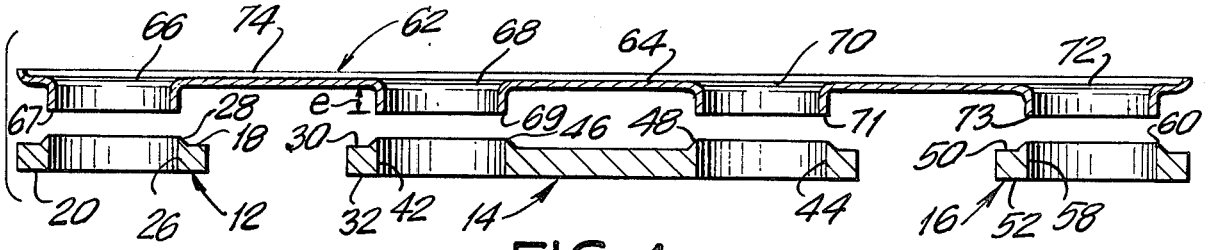
FIG. 4 is a cross-sectional view showing the relationship between the inlet flanges and the inner shell prior to welding.

Turning to FIG. 4, the inlet flanges 12, 14 and 16 are disposed such that the exhaust ports 26, 42, 44 and 58 are in register with the mounting flanges 67, 69, 71 and 73 of the inner shell 62. Additionally, the inlet flanges 12, 14 and 16 are oriented such that the projections 28, 46, 48 and 60 and the adjacent planar sides 18, 30 and 50 of inlet flanges 12, 14 and 16 face the inner shell 62. As a result of this orientation and relative alignment, the mounting flanges 67, 69, 71 and 73 may telescopingly engage the exhaust ports 26, 42, 44 and 58. Additionally, the planar portion 64 of the inner shell 62 will be parallel to the surfaces 18, 30 and 50, but will be spaced therefrom by a distance "b" equal to the height of the respective projections 28, 46, 48 and 60. This spacing will be caused by direct abutment between planar portion 64 of inner shell 62 and the projections 28, 46, 48 and 60.

Figure 5:
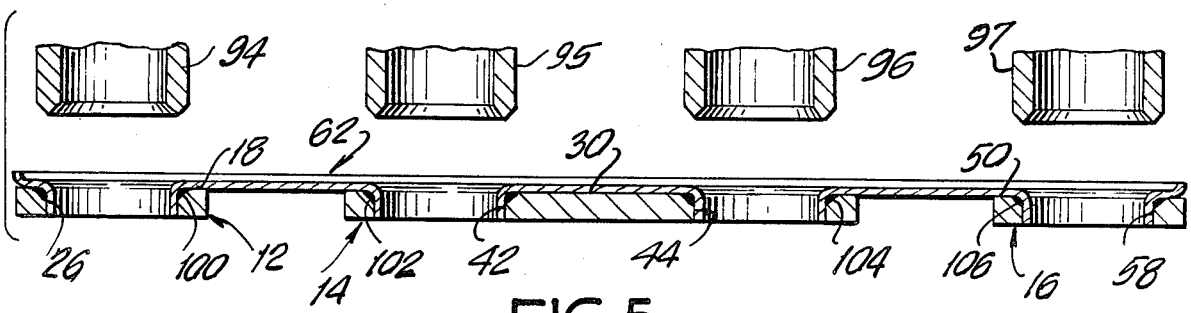
FIG. 5 schematically shows a projection welding apparatus for securing the inner shell to the inlet flanges in accordance with the subject invention.

The next step of the process involves the projection welding of the inner shell 62 to the inlet flanges 12, 14 and 16. More particularly, a welding apparatus including electrodes 94–97 is provided with the electrodes 94–97 substantially corresponding in size and shape to the projections 28, 46, 48 and 60. The electrodes 94–97 are urged into contact with the portions of the inner shell 62 substantially directly opposite the projections 28, 46, 48 and 60, and cause the fusing of the inner shell to the inlet flanges 12, 14 and 16. More particularly, the electrodes 94–97 cause the projections 28, 46, 48 and 60 to define the weldments securely joining sides 18, 30 and 50 of the inlet flanges 12, 14 and 16 to the inner shell 62. The resulting weldments 100, 102, 104 and 106 are illustrated in FIG. 5. These weldments 100, 102, 104 and 106 extend continuously around the respective exhaust ports 26, 42, 44 and 58 at the locations where the mounting flanges 67, 69, 71 and 73 meet the planar portion 64 of inner shell 62. By virtue of this location of weldments 100, 102, 104 and 106, a continuous airtight seal is provided between the inlet flanges 12, 14 and 16 and the inner shell 62. Thus, the escape of exhaust gases from the engine is positively prevented. Furthermore, the location of weldments 100, 102, 104 and 106 and the projection welding process described herein positively prevents excess weld material from being deposited on surfaces 20, 32 or 52 of the inlet flanges 12, 14 and 16 respectively. Similarly, excess weld material is prevented from becoming deposited on the opposed surface of the inner shell 62 corresponding to the inside of the exhaust chamber.

Figure 6:
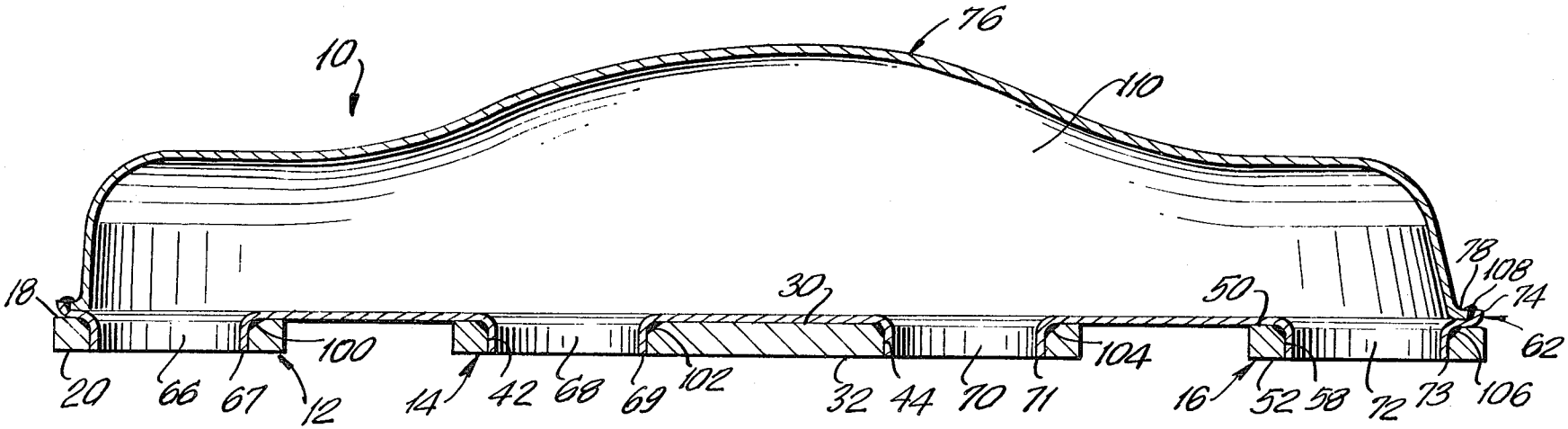
FIG. 6 is a cross-sectional view of a manifold formed in accordance with the process of the subject invention.

The manifold 10 is further formed by mounting the outer shell 76 to the inner shell 62 such that the respective peripheral flanges thereof 78 and 74 engage one another. The outer shell 76 and the inner shell 72 are then welded to one another along seam 108 to define an exhaust chamber 110 therebetween, as shown most clearly in FIG. 6. As noted previously, the seam 108 is readily accessible and the weld is well suited to automation.

In summary, a process is provided for manufacturing an exhaust manifold. The manifold includes at least one stamp formed inlet flange, a stamp formed sheet metal inner shell and a stamp formed sheet metal outer shell. Each inlet flange is stamp formed to define at least one exhaust port extending therethrough with a continuous projection extending around each exhaust port and from one surface of the inlet flange. The inner shell includes an inlet aperture for each exhaust port. The inlet apertures include mounting flanges dimensioned to engage the associated exhaust ports of the inlet flanges. The outer shell is stamp formed to mate with the inner shell and define an exhaust chamber therebetween. The outer shell further includes an outlet aperture to engage an outlet tube, which in turn is engageable with the exhaust system of a vehicle. The mounting flanges of the inner shell are urged into telescoping engagement with the exhaust ports of the inlet flanges such that the projections of the respective inlet flanges face and abut the inner shell. The inner shell and the inlet flanges then are projection welded to one another such that the stamp formed projections of the inlet flanges define the weldments therebetween. The stamp formed outer shell then is welded to the inner shell to define an enclosed exhaust chamber.

While the invention has been described with respect to certain preferred embodiments, it is apparent that various changes can be made thereto without departing from the scope of the invention as defined by the appended claims.

What is claimed is:

1. A method for manufacturing an exhaust manifold, said method comprising the steps of:

providing at least one metallic inlet flange having opposed substantially parallel first and second planar surfaces;

stamp forming said inlet flanges to define a plurality of exhaust ports extending therethrough and to simultaneously define a continuous projection extending from the first surface of each said inlet flange and substantially surrounding each said exhaust port therein;

providing first and second sheets of metal;

stamp forming the first sheet of metal to define an inner shell having a planar portion, an inlet aperture extending through said planar portion for each said exhaust port, and a mounting flange substantially surrounding each said inlet aperture and being angularly aligned to said planar portion;

stamp forming the second sheet of metal to define an outer shell having an outlet aperture extending therethrough, the stamp forming of said first and second sheets of metal being such that said inner and outer shells are configured to define an exhaust chamber therebetween;

mounting the inner shell to each said inlet flange such that the mounting flanges of said inner shell extend through and telescopingly engage the respective exhaust ports of the inlet flange for properly aligning the inner shell to the exhaust ports of the inlet flange, and such that the projections of each said inlet flange abut the planar portion of said inner shell;

simultaneously projection welding the planar portion of the inner shell to the projections of the inlet flange such that said inner shell is fused to each said projection; and welding said outer shell to said inner shell to form the exhaust chamber therebetween.

2. A method as in claim 1 wherein the projection extends from the first surface of said inlet flange a distance approximately equal to the thickness of the first sheet of metal.

3. A method as in claim 2 wherein the projection extends from the first surface of said inlet flange a distance of between approximately 0.04 to 0.06 inches.

4. A method as in claim 1 comprising the further steps of forming an outlet tube and welding said outlet tube to said outlet aperture of the outer shell.

5. A method as in claim 1 wherein each said mounting flange of said inner shell extends a distance from the planar portion of said inner shell no greater then the thickness of the inlet flange.

* * * * *